US010690420B2

(12) United States Patent
Zhang et al.

(10) Patent No.: US 10,690,420 B2
(45) Date of Patent: Jun. 23, 2020

(54) HEAT EXCHANGE TUBE FOR HEAT EXCHANGER, HEAT EXCHANGER AND ASSEMBLY METHOD THEREOF

(71) Applicant: Danfoss Micro Channel Heat Exchanger (Jiaxing) Co., Ltd., Zhejiang (CN)

(72) Inventors: Zhifeng Zhang, Zhejiang (CN); Wenjian Wei, Zhejiang (CN)

(73) Assignee: DANFOSS MICRO CHANNEL HEAT EXCHANGER (JIAXING) CO., LTD., Zhejiang (CN)

( * ) Notice: Subject to any disclaimer, the term of this patent is extended or adjusted under 35 U.S.C. 154(b) by 52 days.

(21) Appl. No.: 15/754,750

(22) PCT Filed: Aug. 12, 2016

(86) PCT No.: PCT/CN2016/094852
§ 371 (c)(1),
(2) Date: Feb. 23, 2018

(87) PCT Pub. No.: WO2017/032228
PCT Pub. Date: Mar. 2, 2017

(65) Prior Publication Data

US 2018/0252475 A1 Sep. 6, 2018

(30) Foreign Application Priority Data

Aug. 25, 2015 (CN) ..... 2015 1 0528384

(51) Int. Cl.
*F28D 7/16* (2006.01)
*F28F 9/013* (2006.01)
(Continued)

(52) U.S. Cl.
CPC ..... *F28D 7/1684* (2013.01); *F28D 7/16* (2013.01); *F28F 1/022* (2013.01); *F28F 1/325* (2013.01);
(Continued)

(58) Field of Classification Search
CPC ..... F28D 7/1684; F28D 7/16; F28F 1/022; F28F 1/325; F28F 9/182; F28F 2275/12;
(Continued)

(56) References Cited

U.S. PATENT DOCUMENTS 360,782 A * 4/1887 Ober ..... F16L 59/026 138/113
417,992 A * 12/1889 Dell ..... F16L 9/18 138/114
(Continued)

FOREIGN PATENT DOCUMENTS

CN 102066866 A 5/2011
CN 202008311 U 10/2011
(Continued)

OTHER PUBLICATIONS

International Search Report for PCT Application No. PCT/CN2016/094852 dated Nov. 7, 2016.
(Continued)

*Primary Examiner* — Ljiljana V. Ciric
(74) *Attorney, Agent, or Firm* — McCormick, Paulding & Huber PLLC

(57) ABSTRACT

A heat exchange tube (51) for a heat exchanger, heat exchanger and assembly method thereof. The heat exchange tube (51) is a combined heat exchange tube having a space (55) at its center, and the space (55) is configured to accommodate an insertion member (57), such that the combined heat exchange tube is expanded in and joined with a corresponding fin hole (53) in the heat exchanger. A heat
(Continued)

exchange tube that is minute or has a small inner diameter can thus be expanded in a heat exchanger fin without employing a brazing process.

16 Claims, 12 Drawing Sheets

(51) Int. Cl.
*F28F 1/02* (2006.01)
*F28F 1/32* (2006.01)
*F28F 9/18* (2006.01)
*B21D 39/04* (2006.01)
*B21D 53/08* (2006.01)

(52) U.S. Cl.
CPC ..... *F28F 9/013* (2013.01); *F28F 9/0132* (2013.01); *F28F 9/182* (2013.01); *B21D 39/046* (2013.01); *B21D 53/08* (2013.01); *F28F 2275/12* (2013.01); *F28F 2275/125* (2013.01)

(58) Field of Classification Search
CPC .... F28F 9/013; F28F 9/0132; F28F 2275/125; B21D 39/046; B21D 53/08
See application file for complete search history.

(56) References Cited

U.S. PATENT DOCUMENTS 520,222 A * 5/1894 Rodin ..... F15D 1/02 138/37
1,150,407 A * 8/1915 Wells ..... F28F 13/12 138/38
1,242,473 A * 10/1917 Prentice ..... F28F 13/12 138/38
1,787,904 A * 1/1931 Heyward ..... B60H 1/00335 165/154
1,961,907 A * 6/1934 Mott ..... F28D 7/12 165/146
2,151,540 A * 3/1939 Varga ..... F28F 3/02 138/117
2,171,253 A * 8/1939 Day ..... F28F 1/28 165/181
2,197,243 A * 4/1940 Moran ..... F28B 1/02 138/38
2,386,159 A * 10/1945 Elder ..... F28F 13/12 138/38
2,467,668 A * 4/1949 Hallberg ..... B21C 23/10 72/479
2,703,921 A * 3/1955 Brown, Jr. ..... B21C 37/225 29/890.036
2,756,032 A * 7/1956 Dowell ..... F28D 21/0008 165/121
2,895,508 A * 7/1959 Drake ..... F28F 1/40 138/38
2,929,408 A * 3/1960 Smith ..... F28F 1/40 138/38
2,960,114 A * 11/1960 Hinde ..... F28F 1/06 138/38
2,993,682 A * 7/1961 Huet ..... F22B 1/162 165/110
2,998,472 A * 8/1961 Bondon ..... H01B 3/30 174/28
3,000,495 A * 9/1961 Downing ..... B65D 75/40 242/160.2
3,110,754 A * 11/1963 Witort ..... H02G 3/0481 174/70 R
3,163,710 A * 12/1964 Witort ..... H02G 3/06 174/84 R
3,336,056 A * 8/1967 Cassel ..... F01N 13/1805 285/124.4
3,358,749 A * 12/1967 Chisholm ..... B01F 5/0646 165/141
3,433,300 A * 3/1969 Pasternak ..... B21C 37/24 165/151
3,585,910 A * 6/1971 Brown ..... E01C 11/106 404/69
3,603,384 A * 9/1971 Huggins ..... F28F 1/022 165/181
3,625,258 A * 12/1971 Phelps ..... F16L 9/18 138/115
3,636,607 A * 1/1972 DeMarco ..... B21K 25/00 29/890.036
3,636,982 A * 1/1972 Drake ..... F28F 1/40 138/38
3,730,229 A * 5/1973 D'Onofrio ..... B21D 11/14 138/114
3,777,502 A * 12/1973 Michie, III ..... F16L 9/18 62/50.7
3,857,680 A * 12/1974 Porta ..... B01J 12/007 422/200
3,865,184 A * 2/1975 Grover ..... B21C 37/205 165/104.26
3,870,081 A * 3/1975 Kleppe ..... F28F 1/40 138/38
3,889,715 A * 6/1975 Lilja ..... F16L 59/025 138/117
3,976,129 A * 8/1976 Silver ..... F22B 25/00 165/154
4,021,676 A * 5/1977 Duffy ..... G21F 5/005 250/506.1
4,023,557 A * 5/1977 Thorne ..... B21C 1/22 126/677
4,031,602 A * 6/1977 Cunningham ..... B21C 37/151 29/890.036
4,090,559 A * 5/1978 Megerlin ..... F28F 1/40 138/38
4,154,296 A * 5/1979 Fijas ..... F28F 1/32 138/38
4,163,474 A * 8/1979 MacDonald ..... B21C 37/225 138/103
4,176,787 A * 12/1979 Gary ..... F28D 21/0008 138/38
4,190,105 A * 2/1980 Dankowski ..... B60H 1/3227 138/38
4,194,560 A * 3/1980 Matsuzaki ..... F01P 11/08 165/141
4,204,309 A * 5/1980 Lefrancois ..... B21C 23/10 29/412
4,250,958 A * 2/1981 Wasserman ..... F28D 20/02 126/618
4,256,170 A * 3/1981 Crump ..... A47L 15/4291 165/146
4,265,275 A * 5/1981 Heller ..... F28F 1/40 138/38
4,286,655 A * 9/1981 Trojani ..... F28F 1/10 138/38
4,296,539 A * 10/1981 Asami ..... F16L 9/19 165/115
4,326,582 A * 4/1982 Rosman ..... F28D 7/026 165/143
4,340,114 A * 7/1982 Levy ..... F25B 39/00 165/110
4,343,350 A * 8/1982 Campbell ..... F24H 1/208 165/11.1
4,345,644 A * 8/1982 Dankowski ..... F28D 1/0246 165/154
4,372,374 A * 2/1983 Lee ..... F28D 7/103 165/154
4,373,578 A * 2/1983 Saperstein ..... F28F 9/0234 165/141
4,378,640 A * 4/1983 Buchholz ..... F26B 21/004 165/109.1
4,397,304 A * 8/1983 Villain ..... F24S 10/753 126/593
4,407,351 A * 10/1983 Backlund ..... F24V 50/00 165/45

(56) References Cited

U.S. PATENT DOCUMENTS 4,412,558 A * 11/1983 Burke ..... F28F 13/12 122/155.2
4,419,802 A * 12/1983 Riese ..... B21C 37/151 165/179
4,513,601 A * 4/1985 Herbulot ..... B21D 15/02 138/116
4,641,705 A * 2/1987 Gorman ..... F28F 13/125 165/109.1
4,657,074 A * 4/1987 Tomita ..... F24H 3/065 165/179
4,705,914 A * 11/1987 Bondon ..... H01B 9/065 174/28
4,729,409 A * 3/1988 Paul ..... H02G 3/0487 138/115
4,743,329 A * 5/1988 Hata ..... B21D 49/005 156/287
4,778,002 A * 10/1988 Allgauer ..... F16N 39/02 165/141
4,796,693 A * 1/1989 Kastner ..... B21C 37/207 165/133
4,806,705 A * 2/1989 Chen ..... H02G 3/0406 138/108
4,836,968 A * 6/1989 Cakmakci ..... G02B 6/4459 264/177.19
4,906,496 A * 3/1990 Hosono ..... F16L 9/18 428/36.9
4,937,064 A * 6/1990 Gonzalez ..... C01G 23/075 138/38
5,000,426 A * 3/1991 Campana ..... B23K 35/0216 266/48
5,004,046 A * 4/1991 Jones ..... F28D 7/022 165/156
5,058,266 A * 10/1991 Knoll ..... B23K 1/0012 165/179
5,167,275 A * 12/1992 Stokes ..... F28F 13/12 165/109.1
D345,197 S * 3/1994 Potter ..... D23/266
5,375,654 A * 12/1994 Hougland ..... F28F 13/12 138/38
5,551,504 A * 9/1996 Zifferer ..... B21C 37/151 165/155
5,604,982 A * 2/1997 Kent ..... B21C 37/151 29/727
5,660,230 A * 8/1997 Obosu ..... F28F 1/325 165/151
5,722,485 A * 3/1998 Love ..... F28F 1/325 165/151
5,738,168 A * 4/1998 Patel ..... F28F 1/325 165/151
5,901,988 A * 5/1999 Aihara ..... F01N 13/08 138/115
5,905,231 A * 5/1999 Houte ..... B60R 16/0215 138/165
5,924,456 A * 7/1999 Simon ..... F16L 11/121 138/115
5,924,457 A * 7/1999 Inaba ..... F16L 9/17 138/162
6,000,461 A * 12/1999 Ross ..... F28D 1/0391 138/115
6,019,169 A * 2/2000 Ruppel ..... F28D 1/0366 165/153
6,070,657 A * 6/2000 Kunkel ..... F24H 9/0026 165/158
6,116,290 A * 9/2000 Ohm ..... F16L 59/143 138/149
6,122,911 A * 9/2000 Maeda ..... F01N 13/102 285/131.1
6,173,763 B1 * 1/2001 Sano ..... F28F 1/32 165/133
6,283,159 B1 * 9/2001 Tada ..... F16L 9/18 138/111
6,332,302 B1 * 12/2001 Asai ..... B21C 37/0803 138/115
6,360,782 B1 * 3/2002 Yoshitoshi ..... F01N 13/08 138/109
D455,819 S * 4/2002 Hoenig ..... D23/259
6,365,837 B2 * 4/2002 Mitchem ..... H01B 7/065 138/110
6,394,142 B1 * 5/2002 Woelfel ..... F16L 11/22 138/115
6,450,205 B1 * 9/2002 Check ..... F16L 9/19 138/104
6,481,492 B1 * 11/2002 Zhu ..... C10G 9/20 122/235.17
6,564,831 B1 * 5/2003 Sanoner ..... F16L 9/19 138/115
6,575,198 B2 * 6/2003 Yoshitoshi ..... B21C 37/0803 138/115
6,732,788 B2 * 5/2004 Keith ..... F28F 13/12 138/38
6,918,246 B2 * 7/2005 Fukumoto ..... F01N 13/08 60/272
6,918,839 B2 * 7/2005 Holemans ..... F16C 3/026 464/181
6,920,917 B2 * 7/2005 Inoue ..... F28D 7/106 165/154
6,929,035 B2 * 8/2005 Debaisieux ..... B21C 37/14 138/115
7,077,165 B2 * 7/2006 Takasaki ..... F16L 9/18 138/108
7,108,139 B2 * 9/2006 Nguyen ..... B01D 27/06 210/437
7,169,292 B2 * 1/2007 Chae ..... C10G 9/20 138/37
7,252,177 B2 * 8/2007 Minato ..... F01N 13/10 181/240
7,255,155 B2 * 8/2007 O'Donnell ..... F24H 9/0026 165/109.1
7,264,394 B1 * 9/2007 Liles ..... B01F 5/0646 366/339
D574,932 S * 8/2008 Zhuang ..... D23/266
7,431,053 B2 * 10/2008 Suzuki ..... F16L 9/19 138/111
7,637,287 B2 * 12/2009 Reinhard ..... F16L 35/00 138/108
7,779,851 B2 * 8/2010 Mallookis ..... E04H 15/50 135/114
7,866,378 B2 * 1/2011 Nakamura ..... F16L 7/00 165/156
7,967,032 B2 * 6/2011 Harada ..... F02B 29/0456 138/116
7,984,752 B2 * 7/2011 Yusa ..... F28D 7/106 165/141
8,047,451 B2 * 11/2011 McNaughton ..... B60S 1/487 237/12.3 B
8,162,034 B2 * 4/2012 Bonner ..... F28D 1/06 138/172
8,162,040 B2 * 4/2012 Briselden ..... F23C 3/002 165/109.1
8,716,624 B2 * 5/2014 Johnson ..... B21D 5/086 219/121.64
8,809,682 B2 * 8/2014 Hepfinger ..... H02G 9/065 138/115
9,091,487 B2 * 7/2015 Byon ..... F28D 7/106
9,175,644 B2 * 11/2015 Keating ..... F02M 26/43
9,897,387 B2 * 2/2018 Glass ..... F28D 7/0066
2003/0188852 A1 * 10/2003 Yamada ..... B21D 53/02 165/151
2006/0096745 A1 * 5/2006 Cox ..... F28D 7/026 165/156
2007/0151716 A1 * 7/2007 Lee ..... F28F 1/325 165/151
2009/0308585 A1 * 12/2009 Chen ..... F28D 1/0475 165/185

(56) References Cited

U.S. PATENT DOCUMENTS

2012/0222845 A1* 9/2012 Kinder ..... F28F 13/12
165/154

FOREIGN PATENT DOCUMENTS

| | | | |
|---|---|---|---|
| CN | 103837014 | A | 6/2014 |
| CN | 103940284 | A | 7/2014 |
| CN | 205049038 | U | 2/2016 |
| DE | 9315296 | U1 | 4/1994 |
| EP | 2312254 | A1 | 4/2011 |
| GB | 2 208 539 | A | 4/1989 |
| JP | 2001091180 | A | 4/2001 |
| JP | 2008261518 | A | 10/2008 |
| WO | 0226370 | A1 | 4/2002 |
| WO | 2013068488 | A1 | 5/2013 |

OTHER PUBLICATIONS

Supplementary European Search Report for Serial No. EP 16 83 8488 dated Jan. 3, 2019.

* cited by examiner

HEAT EXCHANGE TUBE FOR HEAT EXCHANGER, HEAT EXCHANGER AND ASSEMBLY METHOD THEREOF

CROSS REFERENCE TO RELATED APPLICATION

This application is a National Stage application of International Patent Application No. PCT/CN2016/094852, filed on Aug. 12, 2016, which claims priority to Chinese Patent Application No. 201510528384.9, filed on 25 Aug. 2015, each of which is hereby incorporated by reference in its entirety.

TECHNICAL FIELD

The present invention relates to the fields of heating, ventilation, air conditioning, automobiles, refrigeration and transportation, and particularly relates to a heat exchanger used in an evaporator, a condenser, a heat pump heat exchanger, a water tank, etc., and to an assembly method for the heat exchanger, as well as heat exchange tubes used in the heat exchanger.

BACKGROUND

At present, there are generally two kinds of techniques for manufacturing heat exchangers, one of which is a mechanical tube expansion technique, and the other of which is a brazing technique.

A common tube-fin type heat exchanger 10 is as shown in FIGS. 1-3. The tube-fin type heat exchanger 10 comprises a plurality of fins 1, each of the plurality of fins 1 being provided with fin holes 2; a plurality of heat exchange tubes 3, each of the plurality of heat exchange tubes 3 passing through corresponding fin holes so as to stack the plurality of fins together on top of one another; at least one bend 4, each of the at least one bends 4 being configured to communicate with two corresponding heat exchange tubes of the plurality of heat exchange tubes 3; and at least one collecting pipe 5 configured to distribute a fluid into the corresponding heat exchange tube 3, and to finally lead the fluid out of the tube-fin type heat exchanger 10. Specifically, a refrigerant passes through the heat exchange tubes, while a medium, such as air, passes through the fins.

As shown in the figures, in general, the heat exchange tubes 3 are circular, and the fin holes 2 are circular as well. With the diameter of the fin holes 2 being slightly greater than that of the heat exchange tubes 3, the fins 1 are penetrated by the heat exchange tubes 3, and after the installation of all of the fins, an expanding head 6 of a tube expander protrudes into the heat exchange tubes 3 to carry out tube expanding. The diameter of the expanding head 6 of the tube expander is slightly greater than the diameter of the fin holes 2. After the tube is expanded, it can be ensured that the heat exchange tubes 3 are closely attached to the fins 1.

A micro-channel/parallel-flow heat exchanger 20 is as shown in FIG. 4. The heat exchanger 20 comprises two manifolds 21, a plurality of flat heat exchange tubes 22 extending between the two manifolds 21, and a plurality of fins 23 provided between adjacent heat exchange tubes 22. In addition, an end cover 24 mounted on one end of the manifold 21, a baffle 25 provided in a cavity of the manifold 21, a side plate 26 mounted on one side of the heat exchanger 20, and an inlet/outlet fitting 27 provided on the manifold 21 are also shown.

All the components of the heat exchanger 20 are made of aluminum. After being tightly bundled up as shown in the figure, the flat heat exchange tubes 22 and the fins 23 are sent into a brazing furnace for brazing, such that the fins 23 and the flat heat exchange tubes 22 are welded together after leaving the furnace. The brazing process includes spraying brazing flux, drying, heating, welding, cooling, etc.

However, as is well known, for a given size of heat exchanger, the smaller the hydraulic diameter of the heat exchange tubes, the higher the heat exchange performance and the lower the material costs. However, the mechanical tube expansion technique is greatly affected by the diameter of the heat exchange tubes, and can currently only be applied to heat exchange tubes with a diameter greater than 5 mm.

Moreover, for a conventional heat exchange tube, taking factors such as the cost and heat exchange efficiency into consideration, the wall thickness is generally designed to be very thin, and when the mechanical tube expansion technique is employed, the tube wall is prone to being expanded until same bursts, causing the product to be scrapped.

As for the other soldering technique, it can be used for heat exchangers having heat exchange tubes with a small hydraulic diameter. Micro-channel heat exchangers usually use this technique and have a relatively good heat exchange performance. However, on one hand, problems, such as the complex brazing process, high equipment investment and unstable product quality, greatly limit the market competitiveness of micro-channel heat exchangers. On the other hand, since the products need to undergo high temperature welding, it is impossible to make an anti-corrosion layer or hydrophilic layer on the materials of the fins, leading to a lower anti-corrosion performance and drainage capacity than tube-fin type heat exchangers.

SUMMARY

It is an object of the present invention to overcome or at least mitigate the deficiencies or defects of the two brazing techniques as mentioned above.

According to one aspect of the present invention, provided is a heat exchange tube for a heat exchanger, a heat exchanger and an assembly method thereof.

According to one aspect of the present invention, a heat exchange tube for a heat exchanger is provided, the heat exchange tube is a combined heat exchange tube having a space at the center, which space is used to accommodate an insert, so as to expand and joint the combined heat exchange tube in a corresponding fin hole in the heat exchanger.

In one example, an outer surface of the combined heat exchange tube is substantially circular, and the fin hole is in the same shape as the combined heat exchange tube.

In one example, the combined heat exchange tube comprises at least two heat exchange sub-tubes separated from one another.

In one example, the outer surfaces of the at least two heat exchange sub-tubes are connected to one another via a connecting sheet.

In one example, the connecting sheet is stretched or cracked when expanding and jointing the at least two heat exchange sub-tubes in the fin hole by using the insert.

In one example, the at least two heat exchange sub-tubes are N heat exchange sub-tubes, where N is a natural number greater than or equal to 2, each of the N heat exchange sub-tubes is a heat exchange sub-tube having one Nth of a circular arc, each of the N heat exchange tubes has a recess at the center thereof corresponding to the respective arc, and the recess is inwardly recessed towards a channel in the heat exchange sub-tube along the extension direction of the heat exchange sub-tube.

In one example, the N recesses form a substantially circular space when the N heat exchange sub-tubes are combined together.

In one example, the number of channels in each of the heat exchange sub-tubes is at least one.

In one example, the insert is an internal expanding tube, and has a shape corresponding to the space.

In one example, the internal expanding tube is hollow, solid or porous.

In one example, a protrusion which protrudes outwards is provided on an outer surface of the internal expanding tube, with the protrusion being inserted into a gap between two adjacent heat exchange sub-tubes when expanding and jointing the heat exchange sub-tubes in the fin hole.

In one example, the internal expanding tube has a number of protrusions which is the same as the number of the heat exchange sub-tubes in each said fin hole.

In one example, the protrusion extends along the extension direction of the internal expanding tube.

According to another aspect of the present invention, a heat exchanger is provided, which comprises:

a plurality of fins, each of the plurality of fins being provided with a fin hole; and a plurality of heat exchange tubes, each of the plurality of heat exchange tubes passing through the fin holes so as to stack the plurality of fins together on top of one another;

at least one of the plurality of heat exchange tubes being the heat exchange tube as mentioned above.

According to yet another aspect of the present invention, an assembly method of the heat exchanger is provided according to that mentioned above, the assembly method comprising:

passing each of a plurality of heat exchange tubes through corresponding fin holes in a plurality of fins, so as to stack the plurality of fins together on top of one another; and inserting an insert into a space at the center of each heat exchange tube, such that each heat exchange tube is expanded and jointed with an inner wall of the fin hole.

In the embodiments of the present invention, the technical solutions of the present invention have the following beneficial technical effects:

1. the embodiments of the present invention address the problem of expanding and jointing or assembling a heat exchange tube having a minute or small inner diameter to a fin;

2. the embodiments of the present invention do not need to employ a brazing process, thereby greatly reducing the manufacturing costs;

3. the embodiments of the present invention reduce the risk of a rupture resulting from the internal expansion of a conventional heat exchange tube; and 4. the embodiments of the present invention divide the heat exchange tube into at least two sub-tubes so as to allow different fluids to pass through the same heat exchange tube.

BRIEF DESCRIPTION OF THE DRAWINGS

These and/or other aspects and advantages of the present invention will become apparent and should be readily understood from the following description of the preferred embodiments in conjunction with the accompanying drawings, in which.

DETAILED DESCRIPTION

By means of the following embodiments and in conjunction with FIGS. 1-11*c*, the technical solutions of the present invention are further specifically described. Identical or similar reference signs in the description denote identical or similar components. The following description of the embodiments of the present invention referring to the accompanying drawings is intended to explain the general inventive concept of the present invention, and should not be construed as limiting the present invention.

Figure 1:
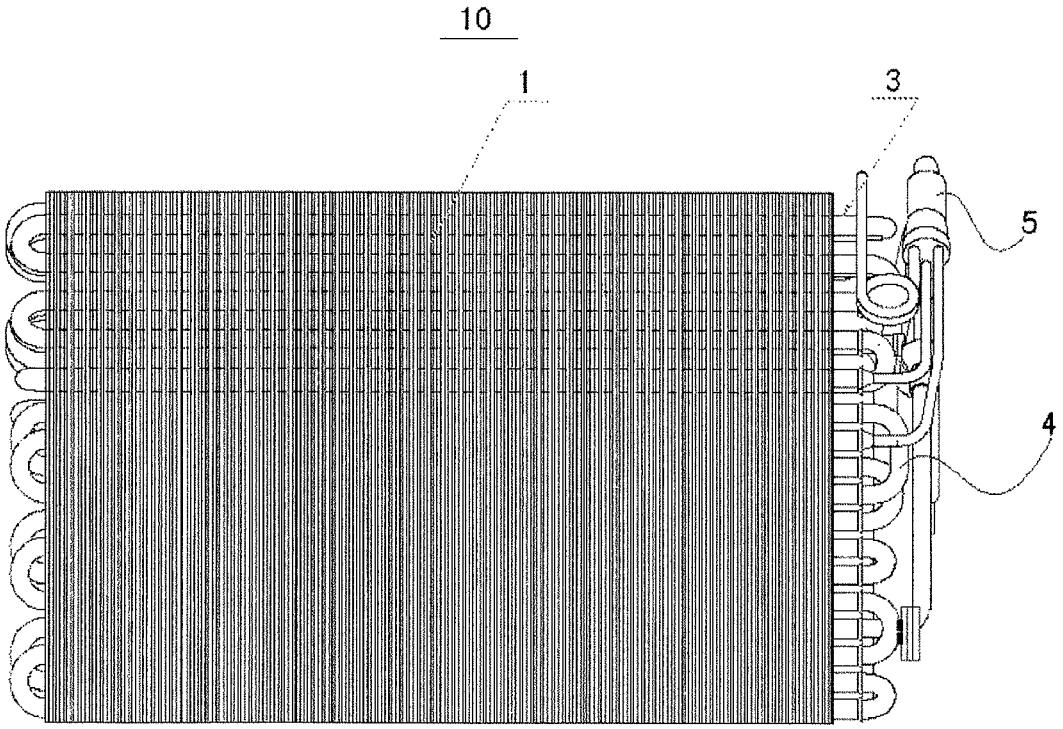
FIG. 1 is a structural view of a tube-fin type heat exchanger in the prior art.
Figure 2A:
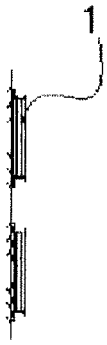
FIGS. 2*a* and 2*b* are respectively a side view and a front view of the fins in FIG. 1.
Figure 2B:
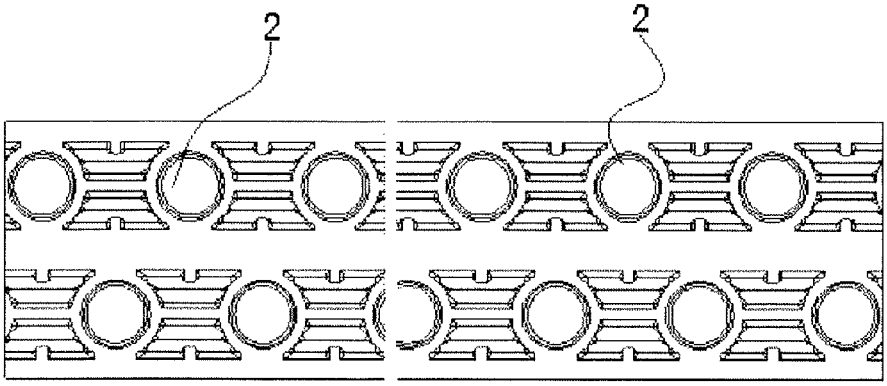
Figure 3:
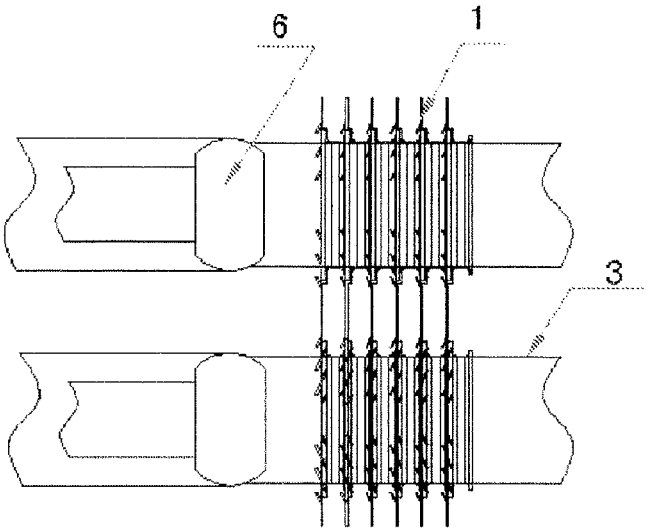
FIG. 3 is a view of the fins in FIG. 1 being tube-expanded by a tube expander.
Figure 4:
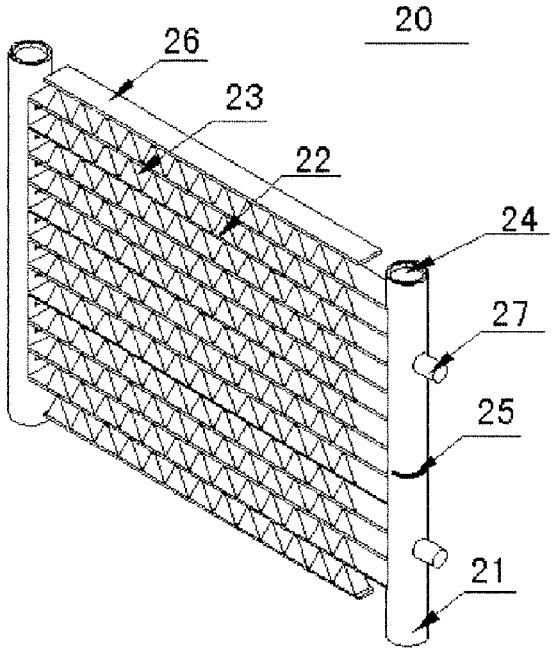
FIG. 4 is a structural view of a micro-channel/parallel-flow heat exchanger in the prior art.
Figure 5A:
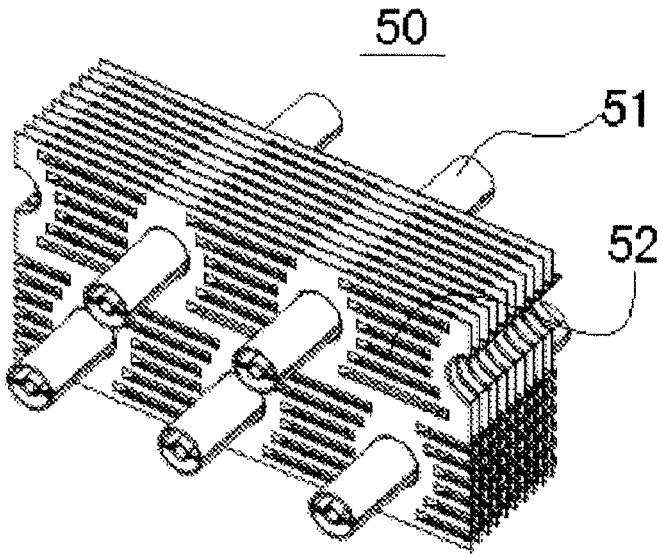
FIGS. 5*a* and 5*b* are respectively a structural view and a front view of the fins and heat exchange tubes assembled together according to an embodiment of the present invention.
Figure 5B:
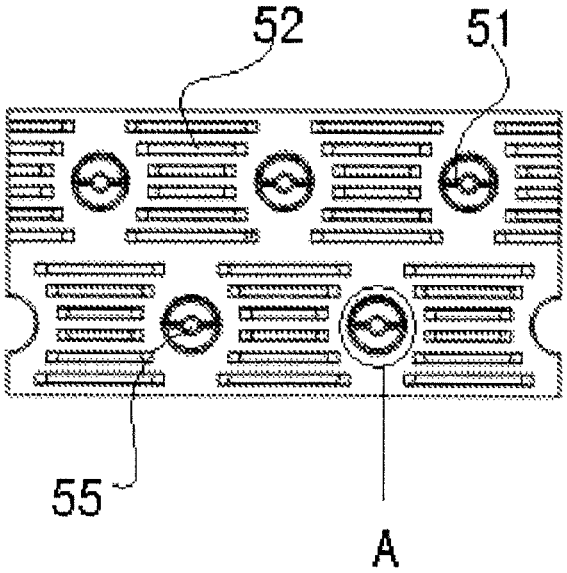

Views of a structure 50 with heat exchange tubes 51 and fins 52 assembled together according to an embodiment of the present invention are as shown in FIGS. 5*a* and 5*b*; As discussed in the Background Art section, those skilled in the art would understand that the combined structure of the heat exchange tubes 51 and the fins 52 as described in the embodiments of the present invention can be used in a tube-fin type heat exchanger, and can also be used in a micro-channel/parallel-flow heat exchanger. In view of the fact that the structures of the tube-fin type heat exchanger and of the micro-channel/parallel-flow heat exchanger have been described in detail in the Background Art, the specific structures of the tube-fin type heat exchanger and the micro-channel/parallel-flow heat exchanger will thus not be described in detail herein. Those skilled in the art may directly use the structure with the fins and the heat exchange tubes assembled together as provided by the embodiments of the present invention to partially replace the respective parts in the above-mentioned corresponding heat exchanger. In other words, the heat exchange tubes of the present invention can be applied to various heat exchangers, according to requirements, without being limited to the specific types of the above-mentioned heat exchangers.

During the actual assembly, the fins 52 are firstly stacked together layer by layer, and are then connected in series via the heat exchange tubes 51, forming the structure as shown in FIG. 5*a*.

In one example, an outer surface of the heat exchange tube 51 is substantially circular, and accordingly, a fin hole 53 is also of a substantially circular shape. That is, the shape of the fin hole 53 and the shape of the heat exchange tube 51 need to be identical or matched. In order to enable the heat exchange tube 51 to pass through the fin hole 53 in the fin 52, the outer diameter of the heat exchange tube 51 is generally arranged to be slightly smaller than the inner diameter of the fin hole 53. Of course, the size relationship between same can be arranged by those skilled in the art according to the requirements.

Figure 5C:
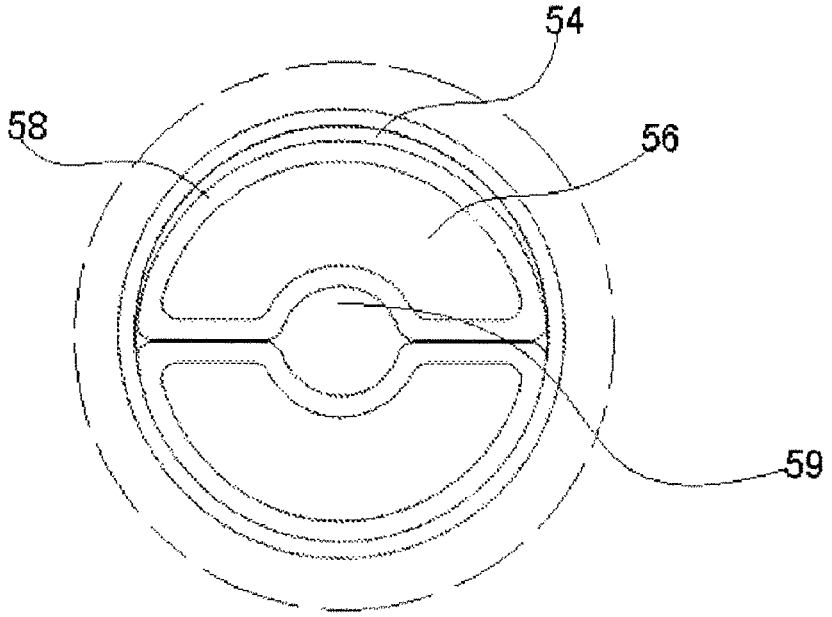
FIG. 5*c* is a detailed view of a circle A in FIG. 5*b;*
Figure 5D:
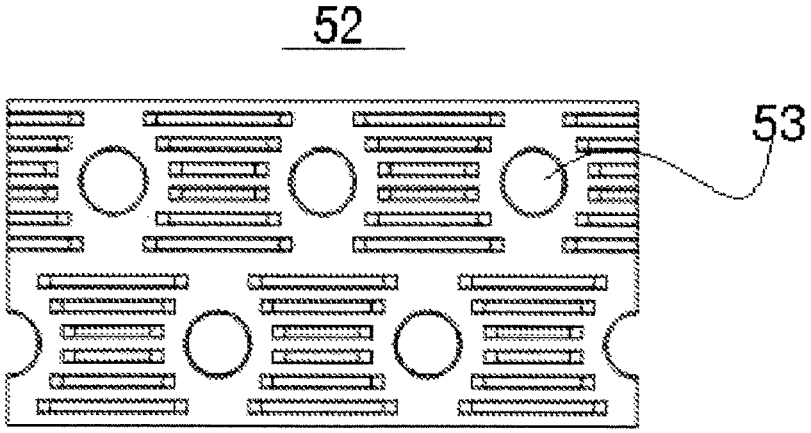
FIG. 5*d* is a front view of the fins.

Referring to FIGS. 5*c* and 5*d*, it can be seen that there are some spaces or gaps 54 between the heat exchange tube 51 and the fin hole 53. This gap 54 is a margin of the fin hole 53 with respect to the heat exchange tube 51, so as to facilitate the passing of the heat exchange tube 51 through stacked layers of fins or a fin package.

As shown in FIGS. 5*a*-5*c*, the heat exchange tube 51 is a combined heat exchange tube having a space 55 at the center. The space 55 is used to accommodate an insert 57 (described in detail hereinafter), so as to expand and joint the combined heat exchange tube in the corresponding fin hole 53 of the heat exchanger.

Specifically, the combined heat exchange tube 51 comprises at least two heat exchange sub-tubes 58 separated from one another. As shown in FIG. 5*c*, the combined heat exchange tube 51 comprises two heat exchange sub-tubes 58. Parts of the outer surfaces of the at least two heat exchange sub-tubes 58 enclose the space 55 at the center of the heat exchange tube 51.

In one example, the at least two heat exchange sub-tubes 58 are N heat exchange sub-tubes, where N is a natural number greater than or equal to 2, each of the N heat exchange sub-tubes 58 is a heat exchange sub-tube having one Nth of a circular arc, each of the N heat exchange tubes 58 has a recess 59 at the center thereof corresponding to the respective arc, and the recess 59 is inwardly recessed towards a channel 56 in the heat exchange sub-tube 58 along the extension direction of the heat exchange sub-tube 58. The N recesses 59 form a substantially circular space 55 when the N heat exchange sub-tubes 58 are combined together.

FIG. 5*c* shows that the combined heat exchange tube 58 comprises two substantially semicircular heat exchange sub-tubes 58. Each heat exchange sub-tube 58 has a substantially semicircular recess 59 at the center thereof corresponding to the respective arc, with the recess 59 being inwardly recessed in the extension direction of the heat exchange sub-tube 58 towards a channel 56 within the heat exchange sub-tube. Each heat exchange sub-tube 58 has a channel 56. Of course, those skilled in the art would specifically design the shape of the recess 59 according to the shape of the insert 57 without being limited to the illustrated instances.

It will be appreciated that, in FIG. 5*c*, the heat exchange sub-tube 58 is semicircular or approximately semicircular; however, as the heat exchange sub-tube 58 itself doesn't participate in the expanding and jointing, the cross section of the heat exchange sub-tube 58 can be any shape, and can also be porous or have capillary pores.

Figure 6A:
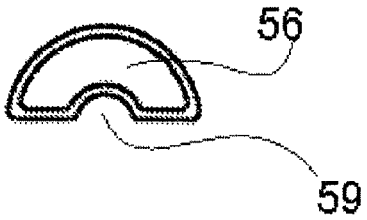
FIGS. 6*a*-6*b* are respectively a front view and a structural view showing one example of a heat exchange sub-tube in FIG. 5*a;*
Figure 6B:
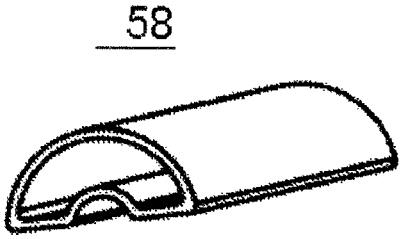

A semicircular heat exchange sub-tube 58 as illustrated in FIG. 5*c* and having a semicircular recess 59 is shown in FIGS. 6*a* and 6*b*.

Figure 6C:
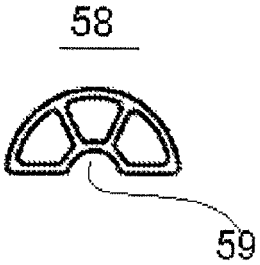
FIGS. 6*c*-6*d* are respectively a front view and a structural view showing another example of the heat exchange sub-tube in FIG. 5*a;*
Figure 6D:
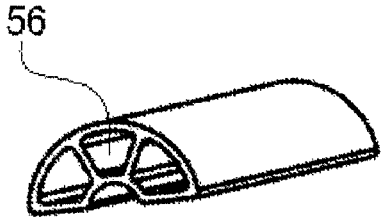

A heat exchange sub-tube 58 is shown in FIGS. 6*c* and 6*d* which is substantially the same as that shown in FIGS. 6*a* and 6*b*, and differs in that each heat exchange sub-tube 58 is in the form of a capillary tube instead of a channel 56. As specifically shown in the figures, three channels 56 are shown. As shown in the figures, the three channels 56 are equal in each heat exchange tube 58. Of course, the three channels 56 can also be provided in unequal or any other suitable forms.

Figure 6E:
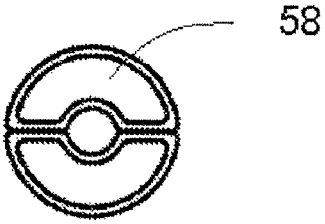
FIGS. 6*e*-6*f* are respectively a front view and a structural view showing a combined heat exchange tube comprising the heat exchange sub-tubes in FIGS. 6*a* and 6*b;*
Figure 6F:
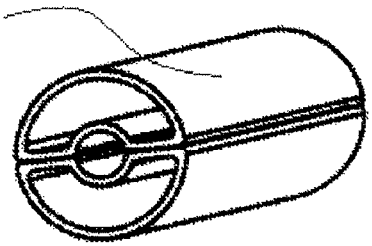

An instance of the combined heat exchange tube 51 being constituted upon fitting the two heat exchange sub-tubes 58 together as shown in FIGS. 6*a* and 6*b* is shown in FIGS. 6*e* and 6*f*. At this time, the outer diameter of the combined heat exchange tube 51 is slightly smaller than the inner diameter of the fin hole 53, so that it can be ensured that the two heat exchange sub-tubes 58 can be inserted side-by-side into a fin package formed by a plurality of fins 52.

Figure 6G:
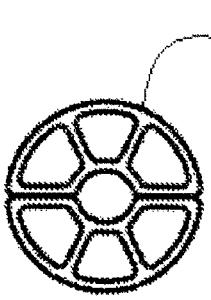
FIGS. 6*g*-6*h* are respectively a front view and a structural view showing a combined heat exchange tube comprising the heat exchange sub-tubes in FIGS. 6*c* and 6*d;*
Figure 6H:
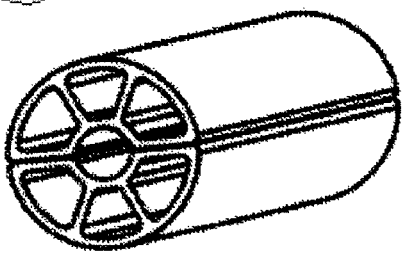

One example of the combined heat exchange tube 51 which is formed by assembling the two multi-channel heat exchange sub-tubes 58 together as shown in FIGS. 6*c* and 6*d* is shown in FIGS. 6*g* and 6*h*.

In the above-mentioned figures, combining two identical heat exchange sub-tubes 58 into a combined heat exchange tube 51 is shown, while, of course, those skilled in the art may arrange the form of the heat exchange sub-tubes 58 to be assembled together according to requirements, without being exactly the same. For example, a single-channel heat exchange sub-tube 58 as shown in FIG. 6*a* is combined together with a multi-channel heat exchange sub-tube 58 as shown in FIG. 6*c*.

It can be seen from the above-mentioned figures that the heat exchange tube 51 mentioned in the embodiments of the present invention can be single-apertured, porous, capillary-pored, etc., that is, the number of channels 56 in a heat exchange tube 51 can be chosen according to the requirements. The space 55 can be circular, square, dovetailed, or other non-circular shapes, etc. It needs to be noted that the number and the cross-sectional shape of the channels in the heat exchange tube 51 herein and the number and the shape of the spaces can be combined arbitrarily without being limited to the instances shown in the figures. When the heat exchange tube 51 has multiple heat exchange channels, different fluids can pass through different heat exchange channels.

Figure 7A:
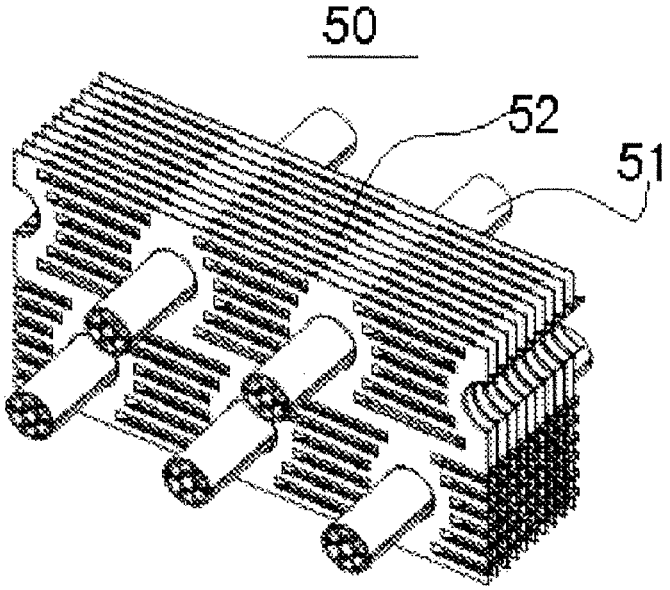
FIGS. 7*a* and 7*b* are respectively a structural view and a front view of the fins and heat exchange tubes assembled together according to another embodiment of the present invention.
Figure 7B:
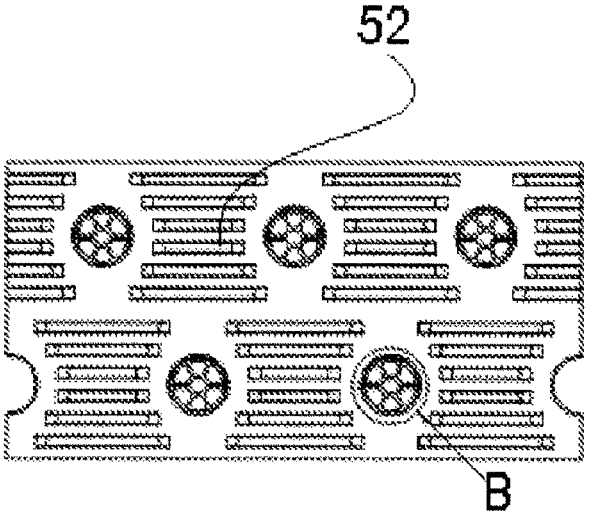
Figure 7C:
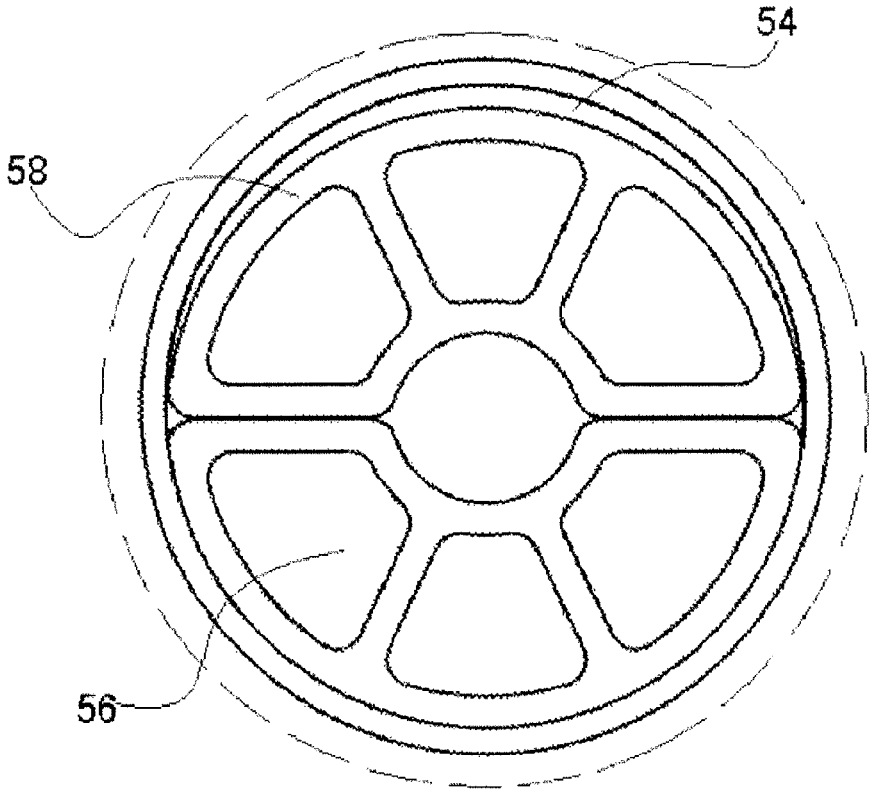
FIG. 7*c* is a detailed view of a circle B in FIG. 7*b;*

Views of a structure 50 with heat exchange tubes 51 and fins 52 assembled together according to another embodiment of the present invention are shown in FIGS. 7*a*-7*c*, which is substantially the same as the example shown in FIGS. 5*a* and 5*b*, and differs merely in that each heat exchange sub-tube 58 has three heat exchange channels 56. Therefore, the content which is the same as that shown in FIGS. 5*a* and 5*b* will not be described again.

Figure 8A:
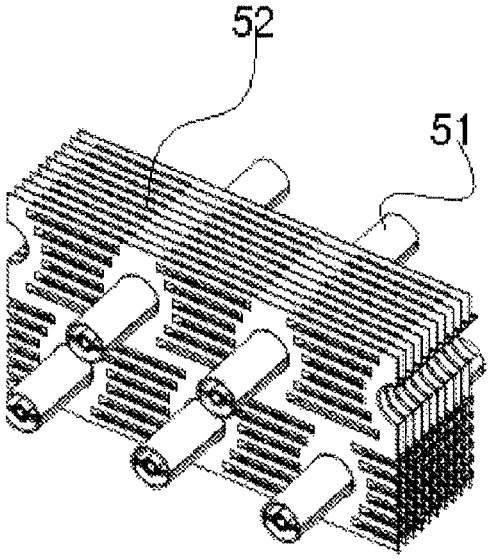
FIGS. 8*a* and 8*b* are a structural view and a front view of the structure of the fins and the heat exchange tubes as shown in FIGS. 5*a* and 5*b* with the inserts having been inserted.
Figure 8B:
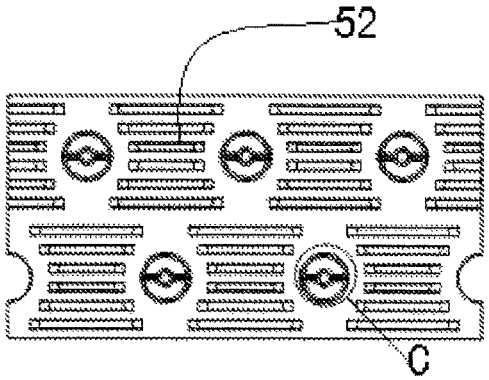

A structural view and a front view of the structure as shown in FIGS. 5*a* and 5*b* with inserts having been inserted are shown in FIGS. 8*a* and 8*b*. After two heat exchange sub-tubes 58 pass through the same fin hole 53, an insert 57 is inserted into the space 55 formed between the two heat exchange sub-tubes 58. After being pushed apart, the two heat exchange sub-tubes 58 come completely into contact with an inner wall of the fin hole 53 (see FIG. 7*c*), so as to achieve the same purpose as the mechanical expanding and jointing. After the insertion is completed, the insert 57 remains between the two heat exchange sub-tubes 58 without being removed again, so as to form a secure bearing for the heat exchange sub-tubes 58.

Figure 8C:
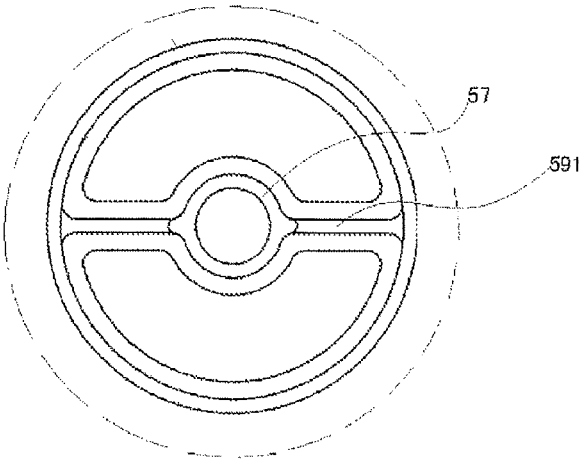
FIG. 8*c* is a detailed view of a circle C in FIG. 8*b;*

It can be seen from FIG. 8*c* that the insert 57 tightly supports the two heat exchange sub-tubes 58, such that the two heat exchange sub-tubes 58 are spaced apart from each other, thereby eliminating the gap between the outer surfaces of the heat exchange sub-tubes 58 and the fin hole 53 to achieve the purpose of mechanical expanding and jointing.

Figure 7D:
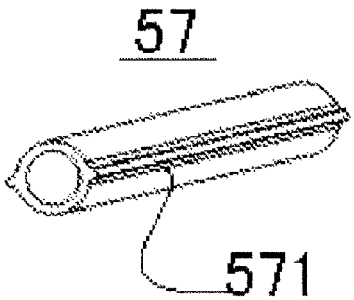
FIGS. 7*d*-7*f* are views of various examples of an insert.
Figure 7E:
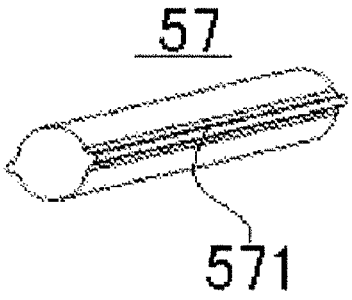
Figure 7F:
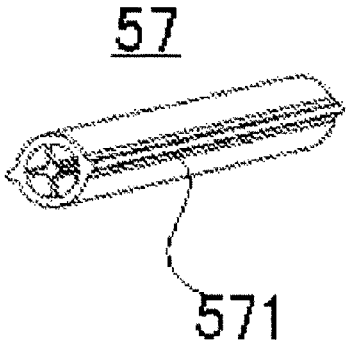

Structural views of various embodiments of the inserts 57 are as shown in FIGS. 7*d*-7*f*. As shown in the figures, in one example, the insert 57 is an internal expanding tube which can be hollow, solid, porous, circular, non-circular, square, dovetailed, etc. The specific shape of the insert 57 needs to correspond to the shape of the space 55 at the center of the corresponding heat exchange tube 51. It needs to be noted that the insert can serve as a reservoir or a superheated/supercooled tube.

Specifically, a protrusion 571 protruding outwards is provided on an outer surface of the internal expanding tube 57, with the protrusion 571 being inserted into the gap 591 between two adjacent heat exchange sub-tubes 58 when expanding and jointing the heat exchange sub-tubes 58 in the fin hole 53. The protrusion 571 extends along the extension direction of the internal expanding tube.

Preferably, in one example, the internal expanding tube 57 has a number of protrusions 571 which is the same as the number of the heat exchange sub-tubes 58 in each said fin hole 53. That is to say, as shown in FIG. 8*c*, when the combined heat exchange tube 51 comprises two heat exchange sub-tubes 58, two gaps 591 are necessarily formed between the two heat exchange sub-tubes 58, and it is thus expected that two protrusions 571 are provided so as to be able to evenly expand and joint the two heat exchange sub-tubes 58 in the fin hole 53. Of course, those skilled in the art may specifically choose the number of the protrusions according to requirements.

Figure 8D:
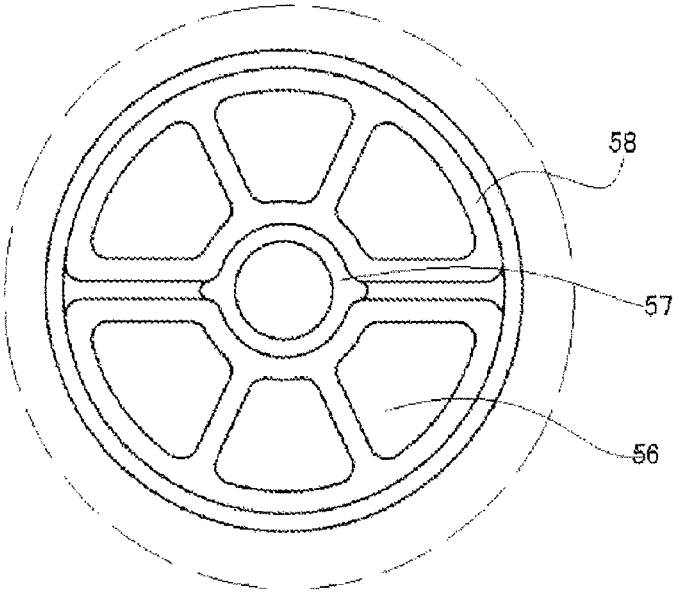
FIG. 8*d* shows a detailed view of the circle C in FIG. 8*b* when another form of combined heat exchange tube is employed.

An instance of expanding and jointing two heat exchange sub-tubes 58 having three channels 56 in the fin hole 53 is shown in FIG. 8*d*, and in view of the fact that this is substantially the same as what is shown in FIG. 8*c*, no further details are given herein.

Figure 9A:
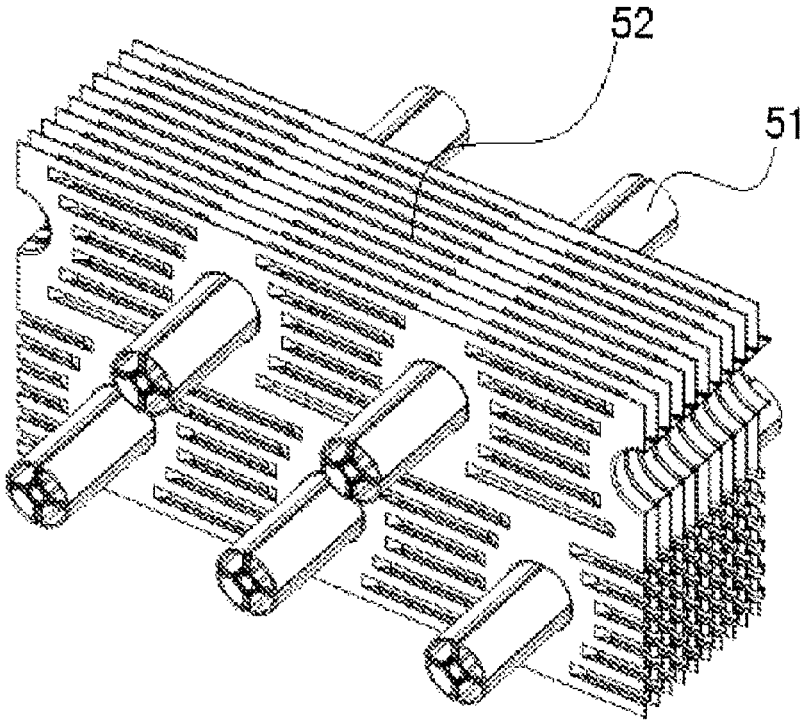
FIGS. 9*a* and 9*b* are a structural view and a front view of the structure of the fins and the heat exchange tubes with the inserts having been inserted according to another embodiment of the present invention.
Figure 9B:
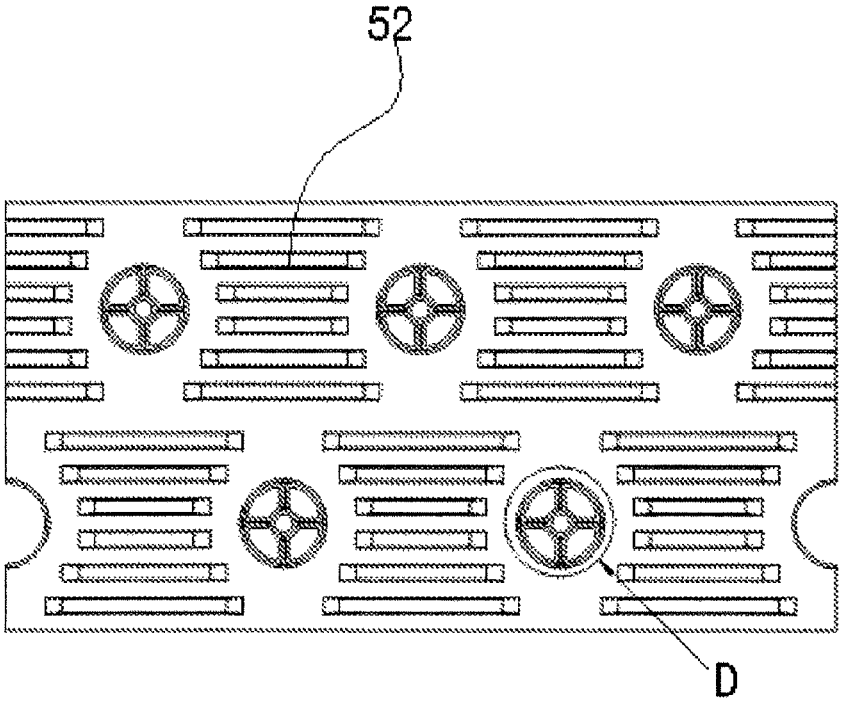
Figure 9C:
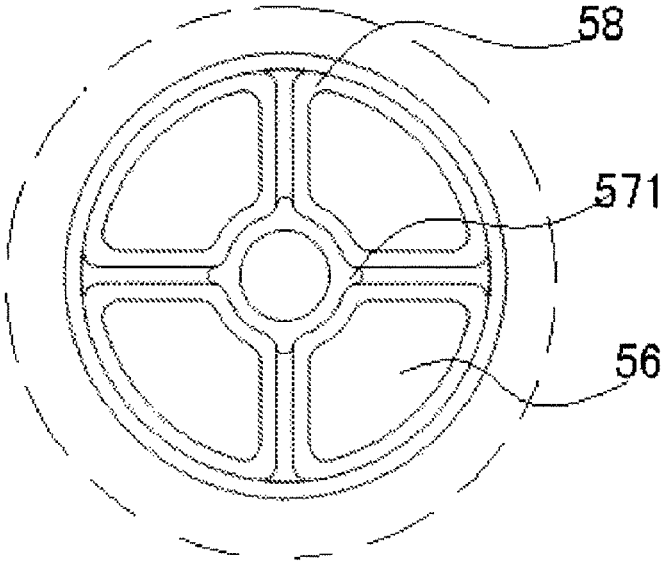
FIG. 9*c* is a detailed view of a circle D in FIG. 9*b;*

An instance of expanding and jointing a combined heat exchange tube 51 of another form in the fin hole 53 is shown in FIGS. 9*a*-9*c*. Specifically, it is substantially the same as the instance shown in FIGS. 8*a*-8*c*, and differs only in that the combined heat exchange tube 51 comprises three or more heat exchange sub-tubes, rather than two heat exchange sub-tubes. Specifically, it needs to be explained that heat exchange sub-tubes 58 in the combined heat exchange tube 51 may not have the same dimensions. For the purpose of facilitating the illustration of the figures, the combined heat exchange tube 51 is shown to comprise four heat exchange sub-tubes 58 of the same dimensions, with each heat exchange sub-tube 58 having a heat exchange channel 56. Of course, each heat exchange sub-tube 58 can be a porous or a capillary type. As mentioned above, since the combined heat exchange tube 51 comprises four heat exchange sub-tubes 58, accordingly, the insert 57 has four protrusions 571, so as to better expand and joint the combined heat exchange tube 51 in the fin hole 53. As shown in FIG. 9*c*, after the expanding and jointing, there is no gap between the combined heat exchange tube 51 and the inner wall of the fin hole 53.

Figure 10:
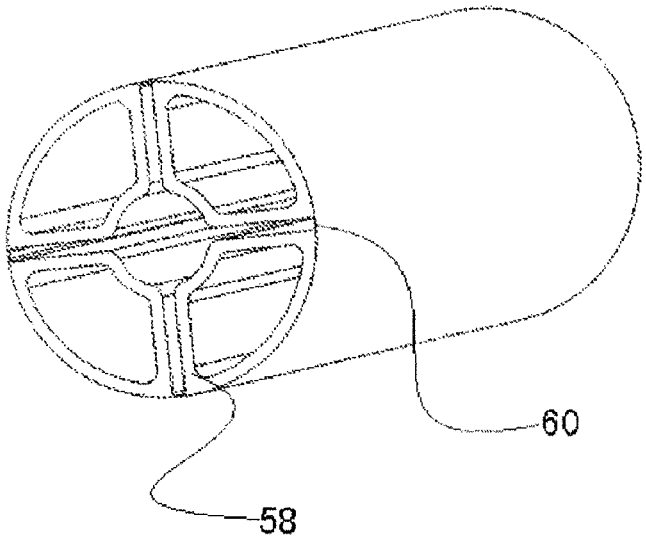
FIG. 10 is a view showing a combined heat exchange tube according to another embodiment of the present invention.

Referring to FIG. 10, when the combined heat exchange tube 51 comprises a plurality of (such as four, as shown in the figure) heat exchange sub-tubes 58, for the purpose of facilitating the assembly of same together in the fin hole 53, the outer surfaces of two adjacent heat exchange sub-tubes 58 can be connected to each other by means of a connecting sheet 60 according to actual requirements. In practice, the connecting sheet 60 can be arranged to be very thin, and after the insertion of the internal expanding tube 57 into the space 59, the connecting sheets 60 among the heat exchange sub-tubes 58 can be cracked or stretched. In summary, the specific forms thereof are not limited, as long as the heat exchange sub-tubes 58 are attached to the inner wall of the fin hole 53 after the internal expanding tube 57 is inserted.

Figure 11A:
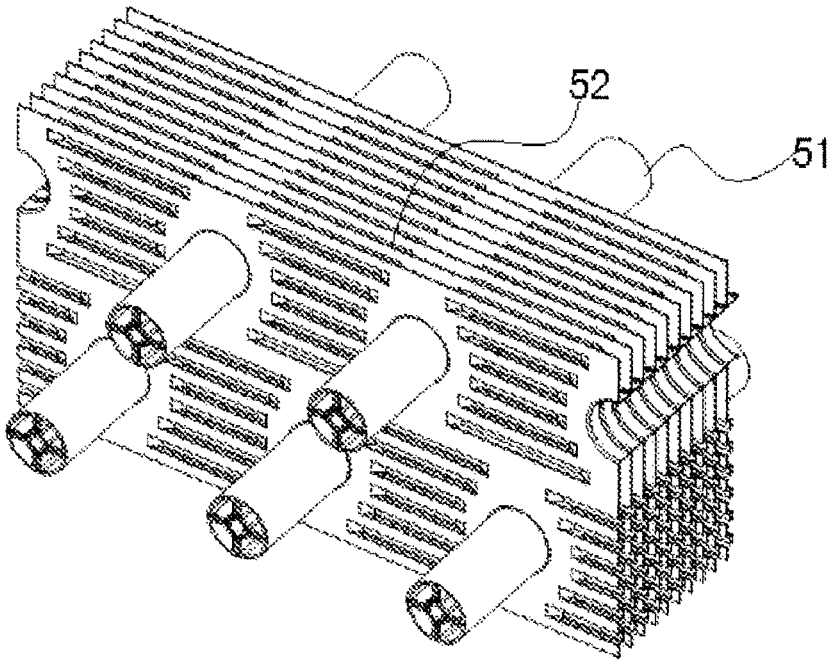
FIGS. 11*a* and 11*b* are a structural view and a front view of the structure of a heat exchanger using the combined heat exchange tubes in FIG. 10 with the inserts having been inserted.
Figure 11B:
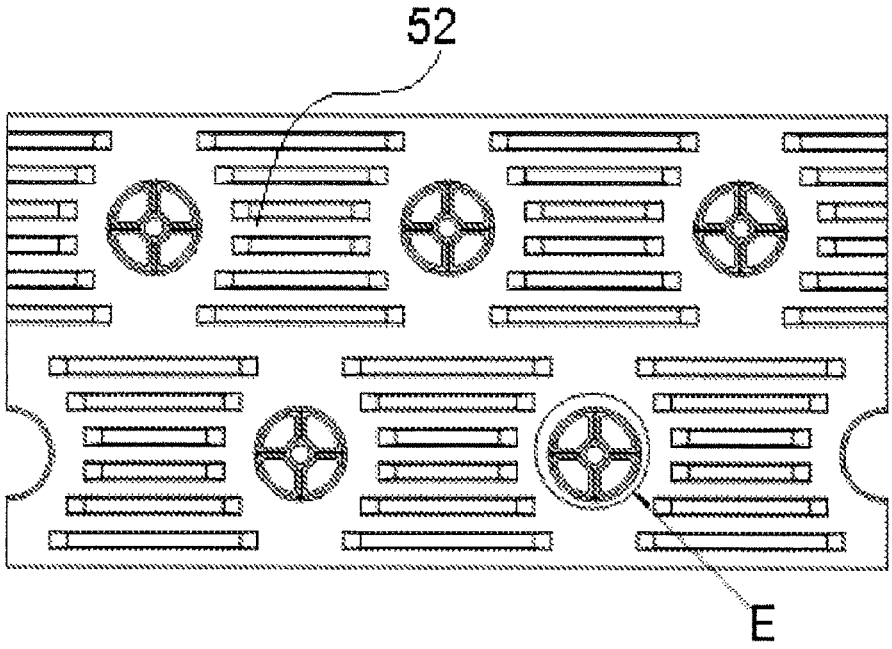
Figure 11C:
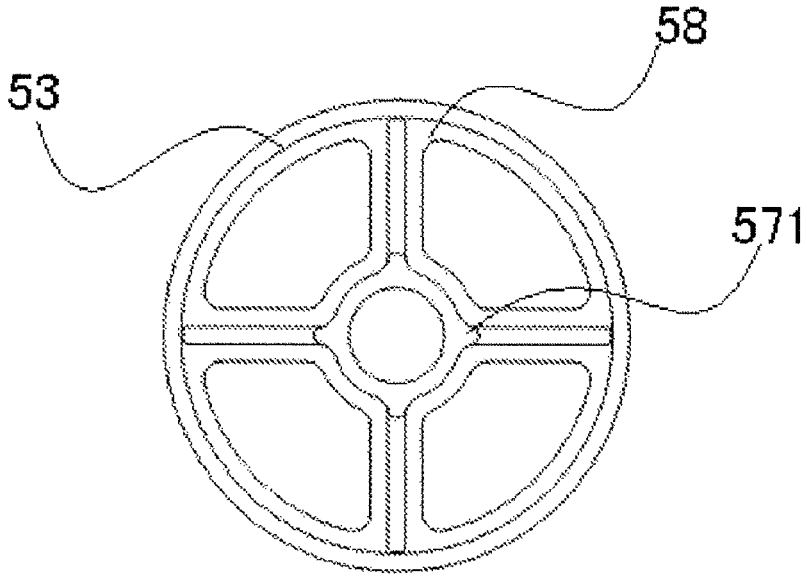
FIG. 11*c* is a detailed view of a circle E in FIG. 11*b*.

An instance of fitting the combined heat exchange tube 51 in the heat exchanger as shown in FIG. 10 is shown in FIGS. 11*a*-11*c*. As seen in the figures, specifically referring to FIG. 11*c*, it is shown that, after the insertion of the insert 57 among the heat exchange sub-tubes 58 of the combined heat exchange tube 51, the connecting sheets 60 are stretched, and the heat exchange sub-tubes 58 are attached to the inner wall of the fin hole 53. Specifically, since the combined heat exchange tube 51 comprises four heat exchange sub-tubes 58, the internal expanding tube 57 is provided with four protrusions 571.

As mentioned above, in one example, when the diameter of the heat exchange tube 51 is required to be less than 5 mm, preferably less than 4 mm or 3 mm, or more preferably less than 2 mm or 1 mm, the insert 57 of the present invention can be used to achieve a firm connection between the heat exchange tube 51 and the fins 52, which has the same or substantially the same technical effect as the mechanical tube expansion technique or the brazing technique. In one example, the heat exchange tube of the present invention can also be applied to an instance where the diameter of the insert is less than 5 mm, preferably less than 4 mm or 3 mm, or more preferably less than 2 mm or 1 mm.

In another embodiment of the present invention, a heat exchanger is provided, characterized in that the heat exchanger comprises:

a plurality of fins, each of the plurality of fins being provided with a fin hole; and a plurality of heat exchange tubes, each of the plurality of heat exchange tubes passing through the corresponding fin holes so as to stack the plurality of fins together on top of one another;

wherein at least one of the heat exchange tubes is the heat exchange tube as mentioned above.

In view of the heat exchange tube used in the heat exchanger being the same as the above-mentioned heat exchange tube, the details regarding same are not described again.

In a still further embodiment of the present invention, an assembly method of the above-mentioned heat exchanger is provided, the assembly method comprising:

passing each of a plurality of heat exchange tubes through corresponding fin holes in a plurality of fins, so as to stack the plurality of fins together on top of one another; and inserting an insert into a space at the center of each heat exchange tube, such that each heat exchange tube is expanded and jointed with an inner wall of the fin hole.

In view of the heat exchange tube used in the assembly method of the heat exchanger being the same as the above-mentioned heat exchange tube, the details regarding same are not described again.

In various examples of the present invention, the heat exchange tube, the heat exchanger and the corresponding assembly method may have the following advantages:

1) the embodiments of the present invention enable the heat exchange tube to be made into a capillary tube, which facilitates the improvement of the tube heating and strength;

2) the intermediate insert of the present invention can serve as a reservoir or a superheated/supercooled tube, which improves the heat exchange of the heat exchange tube;

3) the embodiments of the present invention address the problem that heat exchange tubes of a small size cannot be expanded and jointed by means of conventional mechanical expanding and jointing;

4) the embodiments of the present invention address the problem of local ruptures caused by hydraulic expanding and jointing, as well as the problem of sealing during the expanding and jointing;

5) the embodiments of the present invention enable the heat exchange tubes to be diversified, allowing for necessary adjustments according to actual requirements;

6) the embodiments of the present invention address the main difficulty of tube expansion between a heat exchange tube with a small diameter and the fins;

7) in the present invention, compared with a conventional circular single-apertured heat exchange tube, the employment of a split-type porous tube can effectively reduce the filling volume of a working medium, and can increase the surface area of the heat exchange tube, thereby improving the heat exchange efficiency;

8) with respect to a conventional micro-channel porous flat heat exchange tube, the fin assembly method does not require a brazing process, which contributes to reducing costs;

9) compared with the conventional micro-channel flat tube, the assembly of the heat exchange tube and the fins contributes to defrosting and discharging of condensed water, and has a significant meaning for enlarging the application of the micro-channel heat exchanger tubes under heat pump working conditions of a cooling air conditioner.

Above are merely some of the embodiments of the present invention, and it will be understood by those of ordinary skill in the art that changes may be made to these embodiments without departing from the principles and spirit of the general inventive concept, and the scope of the present invention is defined by the claims and their equivalents.

What is claimed is:

1. A heat exchange tube for a heat exchanger, the heat exchange tube comprising:

a combined heat exchange tube having a space at a center of the heat exchange tube, and an insert configured to be accommodated in the space, to expand and joint the combined heat exchange tube in a fin hole in the heat exchanger, wherein the combined heat exchange tube comprises at least N separate heat exchange sub-tubes, where N is a natural number greater than or equal to 2, each of the N heat exchange sub-tubes being a heat exchange sub-tube having one Nth of a circular arc, and each of the N heat exchange a sub-tubes having a centrally located recess corresponding to the respective arc, the recess being inwardly recessed towards a channel in the respective heat exchange sub-tube along the longitudinal direction of the respective heat exchange sub-tube.

2. The heat exchange tube for a heat exchanger as claimed in claim 1, wherein the outer surface of the combined heat exchange tube is circular.

3. The heat exchange tube for a heat exchanger as claimed in claim 2, wherein the outer surfaces of the at least N heat exchange sub-tubes are connected to one another via a connecting sheet.

4. The heat exchange tube for a heat exchanger as claimed in claim 1, wherein parts of the outer surfaces of the at least N heat exchange sub-tubes enclose the space at the center of the heat exchange tube.

5. The heat exchange tube for a heat exchanger as claimed in claim 4, wherein the outer surfaces of the at least N heat exchange sub-tubes are connected to one another via a connecting sheet.

6. The heat exchange tube for a heat exchanger as claimed in claim 1, wherein the outer surfaces of the at least N heat exchange sub-tubes are connected to one another via a connecting sheet.

7. The heat exchange tube for a heat exchanger as claimed in claim 6, wherein the connecting sheet is stretched or cracked when expanding and jointing the at least N heat exchange sub-tubes in the fin hole by using the insert.

8. The heat exchange tube for a heat exchanger as claimed in claim 1, wherein the N recesses encircle a space when the N heat exchange sub-tubes are combined together.

9. The heat exchange tube for a heat exchanger as claimed in claim 1, wherein the number of channels in each heat exchange sub-tube is at least one.

10. The heat exchange tube for a heat exchanger as claimed in claim 1, wherein the insert is an internal expanding tube, and has a shape corresponding to the space.

11. The heat exchange tube for a heat exchanger as claimed in claim 10, wherein the internal expanding tube is hollow, solid or porous.

12. The heat exchange tube for a heat exchanger as claimed in claim 10, wherein the insert comprises a protrusion which protrudes outwardly from an outer surface of the internal expanding tube, the protrusion being configured to be inserted into a gap between two adjacent heat exchange sub-tubes when expanding and jointing the N heat exchange sub-tubes in the fin hole.

13. The heat exchange tube for a heat exchanger as claimed in claim 12, wherein the internal expanding tube has a number of protrusions which is the same as the number of the heat exchange sub-tubes in each said fin hole.

14. The heat exchange tube for a heat exchanger as claimed in claim 12, wherein the protrusion extends along the longitudinal direction of the internal expanding tube.

15. A heat exchanger comprising:

a plurality of fins, each of the plurality of fins provided with a fin hole; and a plurality of heat exchange tubes, each of the plurality of heat exchange tubes passing through the fin holes so as to stack the plurality of fins together on top of one another;

wherein at least one of the plurality of heat exchange tubes comprises a combined heat exchange tube having a space at the center of the heat exchange tube, and an insert configured to be accommodated in the space to expand and joint the combined heat exchange tube in a fin hole in the heat exchanger, wherein the combined heat exchange tube comprises at least N separate heat exchange sub-tubes, where N is a natural number greater than or equal to 2, each of the N heat exchange sub-tubes being a heat exchange sub-tube having one Nth of a circular arc, and each of the N heat exchange sub-tubes having a centrally located recess corresponding to the respective arc, the recess being inwardly recessed towards a channel in the respective heat exchange sub-tube along the longitudinal direction of the respective heat exchange sub-tube.

16. A heat exchange tube for a heat exchanger, the heat exchange tube comprising:

a combined heat exchange tube having a space at a center of the heat exchange tube, and an insert accommodated in the space and configured to expand and joint the combined heat exchange tube in a fin hole in the heat exchanger, wherein the insert is an internal expanding tube having a shape corresponding to the space, and wherein the insert comprises a protrusion protruding outwardly from an outer surface of the internal expanding tube, the protrusion being configured to be inserted into a gap between two adjacent heat exchange sub-tubes when expanding and jointing the two heat exchange sub-tubes in the fin hole.

* * * * *